United States Patent [19]

Bengsch et al.

[11] 4,117,960

[45] Oct. 3, 1978

[54] FOLDING CLOTHES-HANGER

[75] Inventors: Peter Bengsch, Motzfeldtsgate 5, Oslo 1, Norway; Steinar Bjørnstad, Oslo, Norway

[73] Assignee: Peter Bengsch, Oslo, Norway

[21] Appl. No.: 804,372

[22] Filed: Jun. 7, 1977

[51] Int. Cl.[2] ..... A47J 51/10

[52] U.S. Cl. ..... 223/94

[58] Field of Search ..... 223/94, 89

[56] References Cited

FOREIGN PATENT DOCUMENTS

| | | | |
|---|---|---|---|
| 1,415,809 | 9/1965 | France | 223/94 |
| 2,107,506 | 8/1972 | Fed. Rep. of Germany | 223/94 |
| 115,307 | 12/1968 | Norway | 223/94 |
| 759,905 | 10/1956 | United Kingdom | 223/94 |

*Primary Examiner*—George H. Krizmanich

*Attorney, Agent, or Firm*—Cushman, Darby & Cushman

[57] ABSTRACT

A clothes hanger of the folding type. The carrying arm of the clothes hangers are articulated with each other, and at the joint connection have disc-like parts which are equipped with respective blocking notches which engage with a spring-actuated locking member mounted in the carrying piece of the clothes-hanger, the disc-like parts together forming a casing for taking up the spring.

19 Claims, 16 Drawing Figures

FOLDING CLOTHES-HANGER

The invention relates to a folding clothes-hanger, where the carrying arms of the clothes-hanger are articulated with each other and at the joint connection have disc-like parts which are equipped respectively with blocking notches which engage with a spring actuated locking member mounted in the carrying piece of the clothes-hanger.

Such a clothes-hanger is known for example from the Norwegian Pat. No. 115,307. The invention is based upon the known clothes-hanger and aims at providing a clothes-hanger of this type, with a simple and cheap construction so that the clothes-hanger can be manufactured wholly or partially of plastic with a minimum of parts, cheaply and simply, so that an object is obtained which is suitable for mass production. There is undoubtedly a great need for clothes-hangers of this type, for hanging up sweaters, blouses, dresses and the like, but the previous constructions have had a limited market, as they have been too expensive to produce. This principal disadvantage is eliminated by means of the clothes-hanger according to the invention.

According to the invention a clothes-hanger is therefore provided as mentioned in the introduction, which clothes-hanger is characterized by the features appearing in patent claim 1. Additional features in the invention appear in the secondary claims.

In a preferable embodiment, the spring, springs, respectively are fixed to a rotation axle for the two disc-like parts. In an additional, preferable embodiment the characteristic feature is that in one piece with the lower part of the spring, springs, respectively is shaped a carrying component for the release lever, and the lateral end-parts of the carrying component form locking members and lock against edge components or knobs on the disc-like parts on the carrying arms. The spring/-springs, may to advantage be formed of two reversed identical arched strips.

In order to obtain an automatic and spring actuated folding of the two arms to each other in unlocked position, a preferable embodiment of the invention entails that on the disc-like inner walls of the parts are placed knobs which lie against the spring arches and which when stretched at the release of the locking member, are actuated by the spring arches into swinging the carrying arms against each other. The hook may to advantage be constructed separately and when cast, screwed in, snapped in or the like, be fastened in the carrying component which is made in one piece with the spring/springs.

The clothes-hanger according to the invention can be manufactured in only three pieces (if the hook is made in one piece with the springs and carrying component), namely the two carrying arms and the spring or springs which are made in one piece with the release lever and the carrying hook. The manufacturing and assembling are thus reduced to a minimum.

It is an advantage if the carrying arms' blocking knobs can be placed on the inside of disc-like components. Thereby, the blocking can be arranged inside the casing formed by the disc-like components.

In order to improve the stability of the construction, two hook-shaped knobs may preferably be arranged on the release lever, which knobs grip around the disc-like components when the carrying arm is swung out and blocked, and when the carrying arms are folded together. The carrying arms' blocking knobs are preferably shaped in such a way that they control this movement.

In order to make the construction cheaper, the carrying arms can be constructed of wire elements. These are preferably pressed in and caught up in the disc-like components.

Embodiments of the invention will be explained more in detail as follows, and at the same time the advantages the invention brings with it will be pointed out.

In the drawing

FIG. 3 shows the various parts that the embodiment is put together of,

Figure 1:
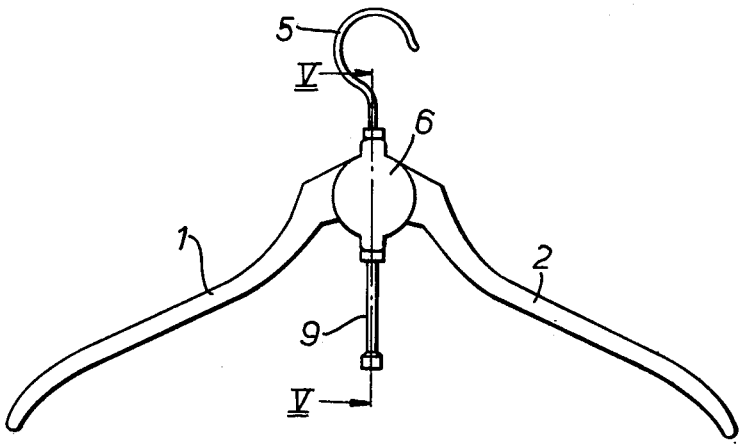
FIG. 1 shows a first embodiment of a clothes-hanger according to the invention.
Figure 2:
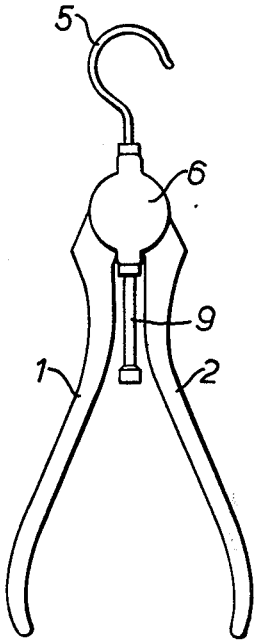
FIG. 2 shows the clothes-hanger in folded condition.

The clothes-hanger in FIGS. 1 and 2 has two articulated carrying arms 1 and 2. In the area by the joint connection the carrying arms are designated with a disc-shaped part 3, 4. The carrying arms 1, 2 are completely alike and are laid reversed against each other when the clothes hanger is put together. The clothes-hanger has a hook 5 which is pivotally fastened in a carrying piece 6. This carrying piece is put together of two parts which are mutually alike. These two pieces are marked 7 and 8 respectively in FIG. 5. In addition, the clothes-hanger has a locking release lever 9 for a blocking mechanism which is located inside the joint connection, i.e., in between the two connected carrying piece halves 7 and 8.

Figure 3:
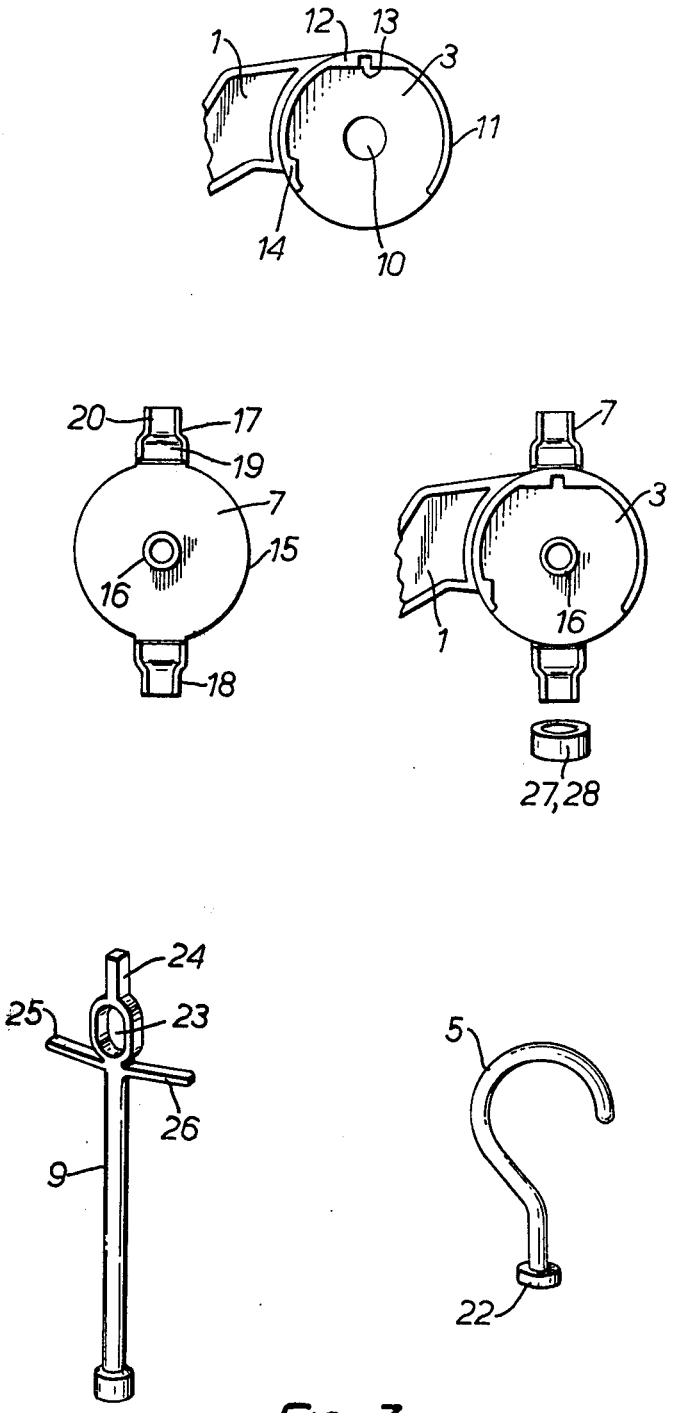
Figure 4:
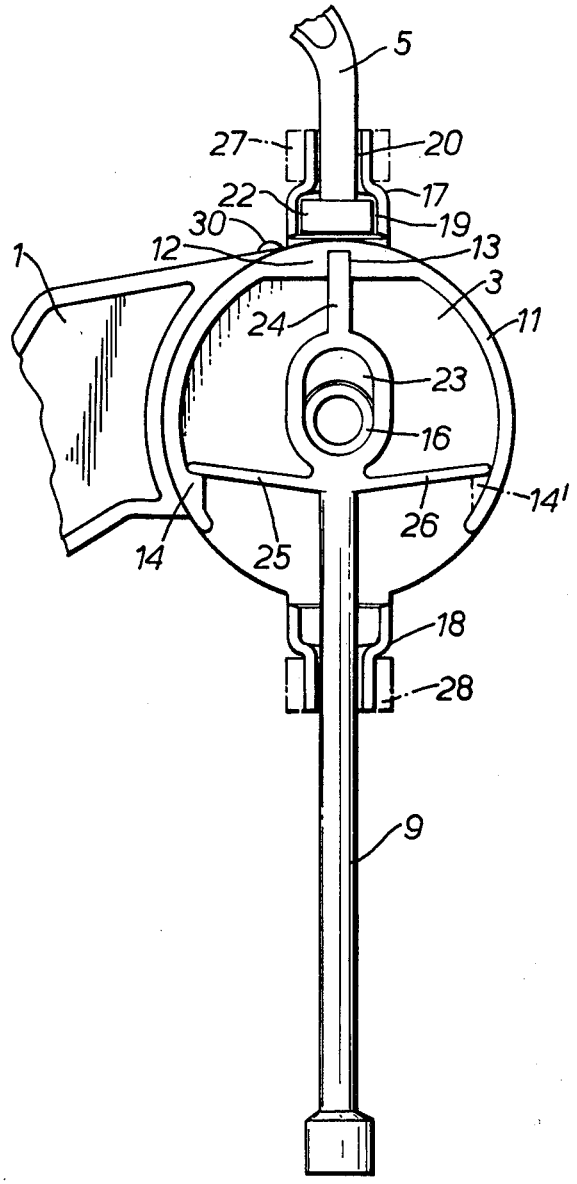
FIG. 4 shows the one clothes-hanger carrying arm with the parts belonging to it mounted.

The construction of the clothes-hanger will be described more in detail with special reference to FIGS. 3, 4 and 5. As mentioned, each carrying arm 1, 2 is identical. In FIGS. 3 and 4 a carrying arm 1 is shown with a disc-shaped part 3. The disc-shaped part has a central, through-going hole 10 and has along the largest part of its circumference an edge 11 protruding upwards from the disc body itself with a thickened section 12 in which is shaped a locking notch 13, and with a thickened part 14 which forms a stop for a spring which will be described more in detail below. On part of the circumference the rim 11 is omitted.

Figure 5:
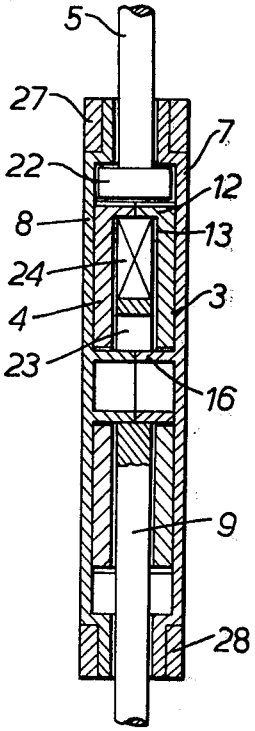
FIG. 5 shows a cross-section through the clothes-hanger in FIG. 1, along line V—V.

When the carrying arms are laid against each other, with the disc-shaped parts flush with each other, the disc-shaped parts will together form a casing, see FIG. 5.

The two carrying arms are held together and the joint connection is provided by means of the carrying piece 6, which consists of two identical halves, 7 and 8, respectively. In FIG. 3 is shown the one half 7. As mentioned, the halves 7 and 8 are alike. The carrying piece half 7 consists of a disc-shaped part 15 with a central peg 16 which protrudes up from the disc surface. On two diametrically opposite sides, two bearing halves, respectively 17 and 18 are shaped in one piece with the disc 15, and these bearing halves 17, 18 have innermost at the side edge an extended part 19 which merges into a narrower half cylindrical part 20.

Two such carrying piece halves are put together, as can be seen from the cross-section in FIG. 5, whereby they grip around the disc-shaped parts 3 and 4 on the two carrying arms 1 and 2. The bearing halves 17, 18 will then form bearings for a hook 5 and a release lever 9 respectively.

When assembling the clothes-hanger, the procedure is such that the one carrying arm 1 with its disc-shaped part 3 is laid against the carrying piece half 7, the carrying piece's half's central peg 16 goes into the hole 10. The parts are then put together as shown in the right half of FIG. 3. The hook 5 is put in place, see FIG. 4. The hook 5 has a widened end part 22 which fits into the widened part 19 of the bearing half 17. Then the release lever is put in place.

The release lever 9 has a construction which is shown in FIGS. 3 and 4 and is in reality a rod element which is equipped with an oblong opening 23 and a flat blocking part 24, and two protruding arms 25, 26 as well, which are flexible and therefore act as springs.

The mounting of the release lever 9 takes place in the following manner, in that the spring arms 25 are placed against the stop 14, shaped on the rim 11 on the carrying arm's disc-shaped part 3. The peg 16 goes into the oblong slot 23.

The other carrying arm 2 is then mounted in reversed position, as carefully ensures that the stop 14 on this carrying arm also interacts correctly with the spring arm 26. In order to illustrate this, this stop 14 indicated with stippled lines in FIG. 4. Then the other carrying piece 8 is put in place, and the whole affair is locked together by means of two rings 27, 28. In order to secure the parts, glue may be used at suitable places, e.g., for securing the rings 27, 28.

As is especially evident in FIG. 4, locking part 24 will engage with the notch 13 in the carrying part 1 and with the corresponding notch in the carrying part 2 when the clothes-hanger is then locked in position for use, by pulling the release lever 9, locking part 24 is disengaged from the notch 13 and the clothes-hanger can then be folded together. When the carrying arms are swung out again, the springs 25, 26 will cause the locking part 24 to snap in again in the blocking notch 13 as soon as the carrying arms are opened out into correct position for use.

A folding clothes-hanger is provided with the invention which is ideally suited for production in a plastic material. The various parts can be easily cast in a mould and the clothes-hanger can be put together very simply. Wherever there is more than one part, the parts are symmetrical, which simplifies the assembling to a considerable degree, in that these two parts can be used interchangeably. The spring mechanism must be emphasized especially, as this construction is very simple, very cheap and very reliable as well, and it is also completely protected inside the casing which is formed by the carrying arm's disc-shaped components.

In FIG. 4 is indicated a stopping knob 30 which prevents the carrying arms from being opened any wider than to the correct position for use, so that the interaction between the locking component 24 and the notch 13 facilitates. This knob 30 is, however, not absolutely necessary. When the carrying arms are opened out, they strike against the bearing 17, as is evident in FIG. 4.

Figure 6:
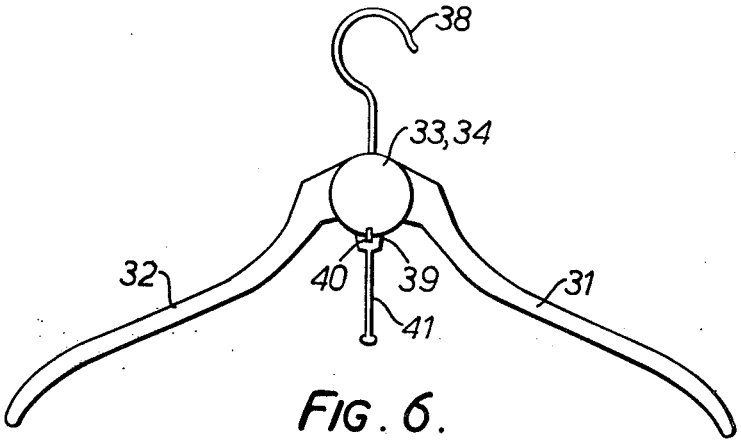
FIG. 6 shows another embodiment of the clothes-hanger in position for use.
Figure 7:
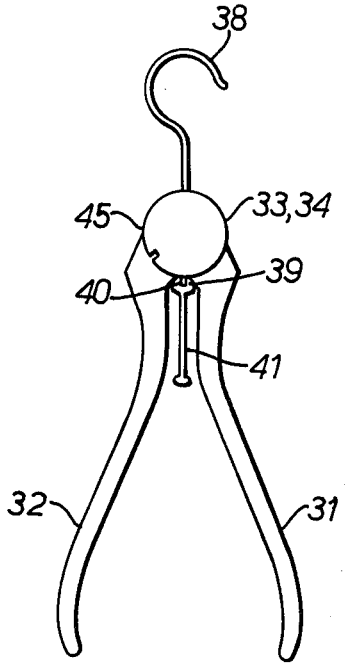
FIG. 7 shows the clothes-hanger in FIG. 6 in folded condition.
Figure 8:
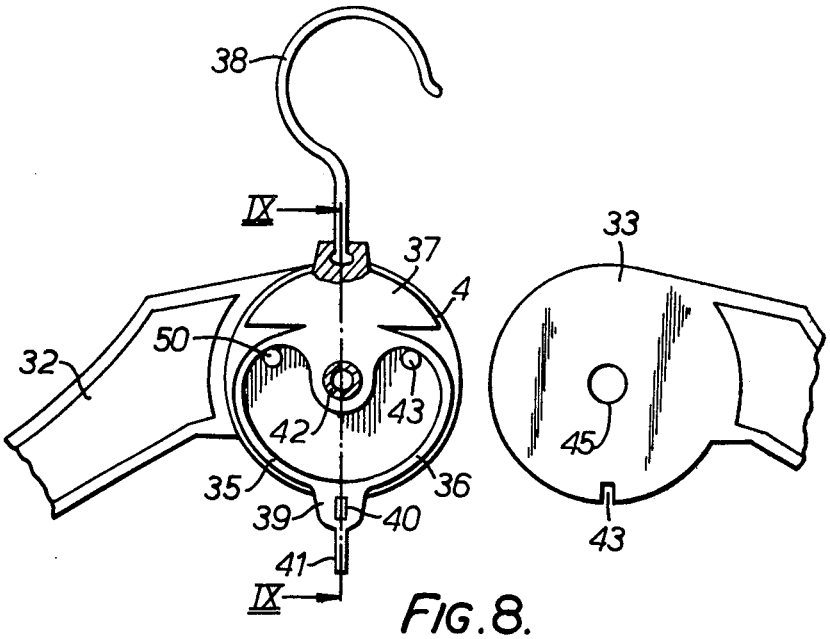
FIG. 8 shows an embodiment of the spring for the clothes-hanger in FIGS. 6 and 7, with attached parts.

FIGS. 6–9 show another embodiment of a clothes-hanger according to the invention. The clothes-hanger has two carrying arms 31 and 32 which are hinged together. At the hinging point or joint connection, the carrying arms are formed with two disc-like parts 33, 34. The carrying arms are identical with the exception of the pivot 42 on the one part 34, and are placed against each other as is evident in FIGS. 6 and 7. Between the disc-like parts 33 and 34 is placed a spring which consists of two curved strips 35 and 36, which are cast in one piece with a bearing component 37 for the hook 38 and a bearing component 39 for a locking catch 40 and a release lever 41. The springs are fixed to the pivot 42. When the clothes-hanger is opened out, as shown in FIG. 6, the locking catches 40 engage with notches or grooves 43 in both the two disc-like parts 33 and 34. When the clothes-hanger is to be disengaged, the release lever 41, is pulled and the locking catches 40 will be drawn out of the notches 43 against the effect of the springs 35, 36, and the carrying arms 31 and 32 can swing freely down to the position shown in FIG. 7.

The rotation axle is cast in one piece with the disc-like part 33 on the arm 32 and is equipped with known snap hooks 44. The assembling is done very simply in that the springs 35, 36 with the carrying component 37, the bearing component 39 and the rod 41, are threaded onto the axle 42. The other arm's disc part 33 is pressed with a central opening 45 in onto the axle 42, so that the snap catches 44 grip over the outer surface of the plate 33. In order to obtain force to bring together the two carrying arms 31 and 32, there are placed knobs 49, 50 on the inside of one or both of the disc-like parts 33, 34, which knobs lie against the upper part of the spring arches 35, 36. When the release lever 41 is pulled, force is exerted on these knobs 49, 50 by the spring arches 35, 36, which spring force tends to bring the arms 31, 32 together.

Figure 9:
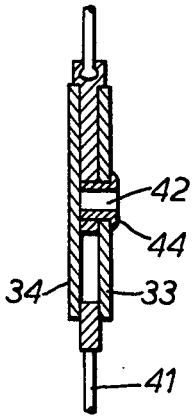
FIG. 9 shows a cross-section along line IX—IX in FIG. 3.
Figure 10:
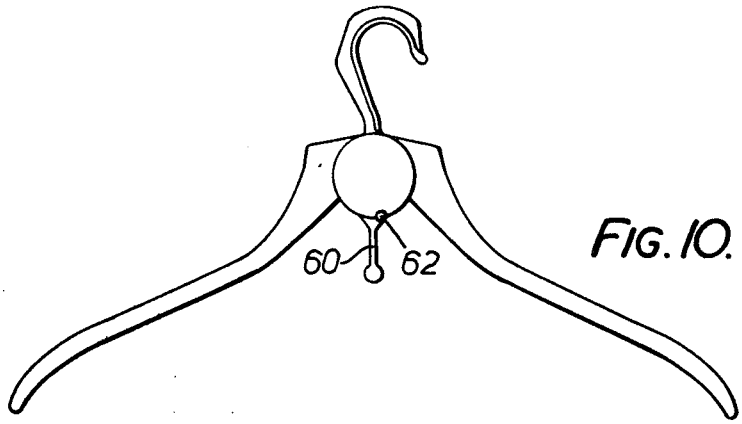
FIG. 10 shows a third embodiment of a clothes-hanger ready for use.
Figure 11:
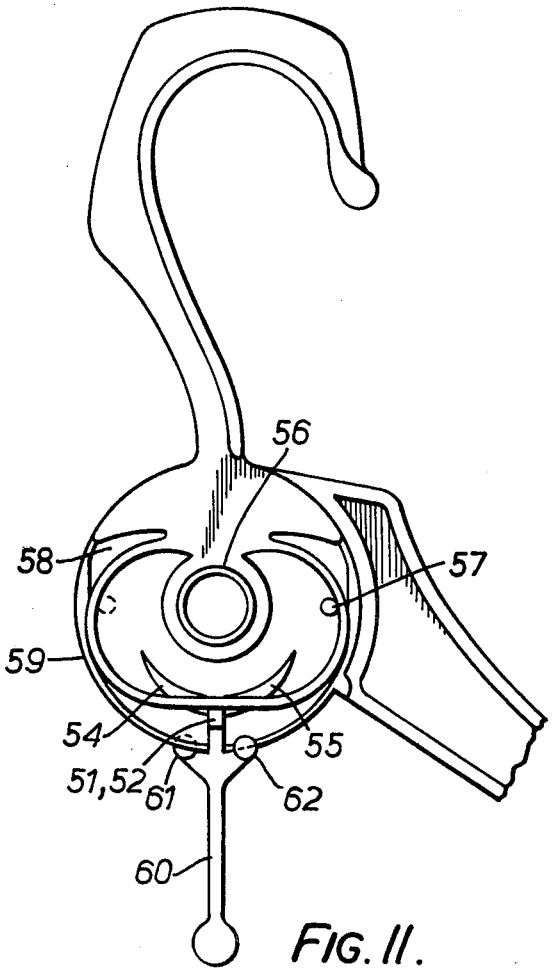
FIG. 11 shows an enlarged cross-section of the clothes-hanger in FIG. 10 with the one carrying arm removed.
Figure 12:
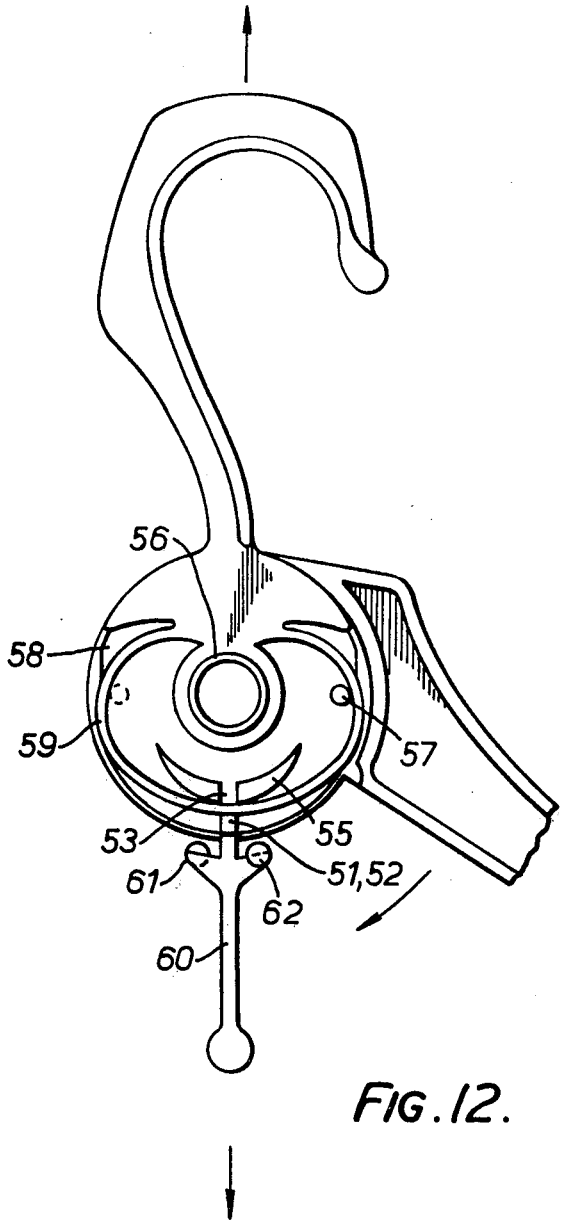
FIG. 12 shows the same cross-section as FIG. 11, with the block raised.
Figure 13:
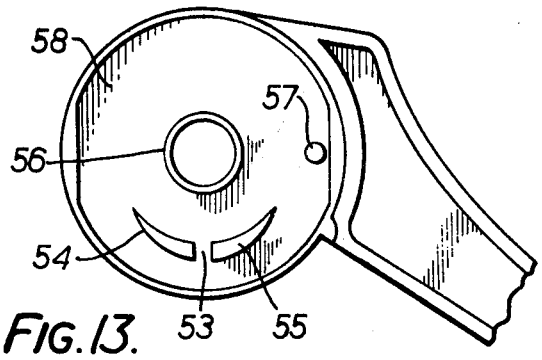
FIG. 13 shows the upper part of the carrying arm in the third embodiment.
Figure 14:
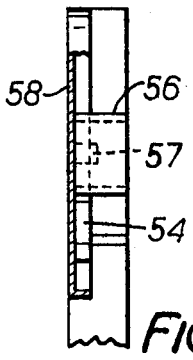
FIG. 14 shows a side view, partly cut through, of the carrying arm shown in FIG. 13.
Figure 15:
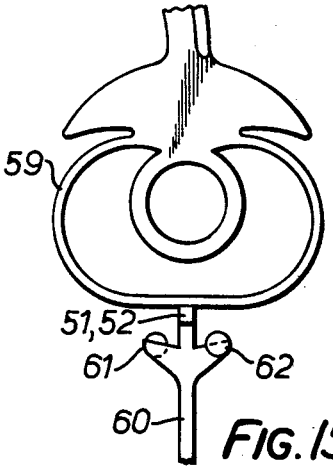
FIG. 15 shows the spring which is used in the third embodiment.
Figure 16:
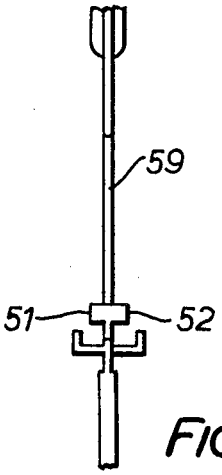
FIG. 16 shows a side view of the spring in FIG. 15.

FIGS. 10–16 show a third embodiment of a clothes-hanger according to the invention. This clothes-hanger is a modified construction of the example in FIGS. 6–9. The main difference is that the blocking is arranged in the casing which is formed of the disc-like parts 58. The blocking catches 51, 52 are intended for blocking engagement with a respective notch 53 between two control knobs 54, 55 which are made in one piece with the disc-like part. The manner of operation may be clearly seen in FIGS. 11 and 12. The rotation peg 56 is constructed here as a hollow cylinder. The peg or knob 57 correspond to the knob 49, 50 in FIGS. 6–9 and actuates the spring arches in spring 59. In this embodiment the disc-like part, not shown, is equipped with a central opening for receiving the pivot 56, in principle in the same manner as shown in FIG. 9. In order to strengthen the construction additionally there are two hook-knobs 61, 62 placed on the release lever 60, which hook-knobs grip around the disc-like parts 58 when the carrying arms are swung out and blocked, and in folded together position, as a result of the control which the knobs 49, 50 give, see FIGS. 10 and 11. This increases the stability of the construction.

Figure 17:
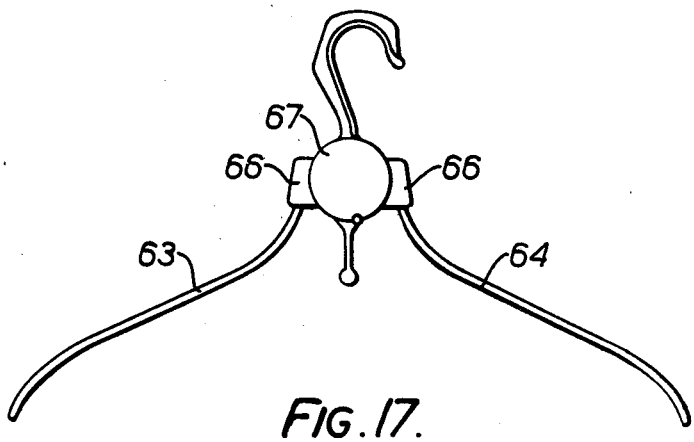

In the construction in FIG. 17, the carrying arms 63, 64 are designed as simple steel wires which are pressed into the receiving parts 65, 66 on the disc-like parts 67. Besides, the spring and locking construction are constructed as in one of the previously mentioned embodiments. Such a construction with metal threads has the advantage of being very reasonable to produce.

Having described our invention, we claim:

1. A folding clothes hanger comprising two arms pivoted for movement relative to each other about a common axis, both arms having each at one end a circular portion arranged coaxial with the common axis, spring means located within an enclosure comprising the said circular portions, a release member extending out from the enclosure, and a locking element, each of said circular portions having engagement means for engagement by the locking element which, when engaging both said engagement means at the same time with the arms extended, prevents relative rotation of the arms, the spring means urging the locking element into engagement with said engagement means, and the release member being operatively connected to the locking element and releasing the locking element from engagement with said engagement means when moved outwardly of the enclosure, the two arms thus being allowed to rotate towards each other.

2. A hanger as in claim 1 wherein the spring means urge the two arms towards each other.

3. A hanger as in claim 1 wherein both said circular portions have an aperture coaxial with the common axis and the enclosure further includes two plates each having a peg, the plates being disposed on the outside of said circular portions, one on each side, with each peg extending into an aperture in one of the circular portions.

4. A hanger as in claim 1 wherein one of said circular portions has an aperture coaxial with the common axis and the other of the said circular portions has a peg extending into the aperture.

5. A hanger as in claim 1 wherein the release member has projections for engaging over the outside of the enclosure.

6. A hanger as in claim 1 wherein the locking element includes a projecting part, wherein the engagement means includes a locking notch in each circular portion, and wherein the release member comprises a rod formed together with the locking element.

7. A hanger as in claim 6 wherein the locking notches are in the circumference of said circular portions.

8. A hanger as in claim 6 wherein the locking notches are in said circular portions inside the enclosure.

9. A hanger as in claim 8 wherein one locking notch on one of said circular portions is provided between two raised portions formed integrally with said one of said circular portions.

10. A hanger as in claim 3 wherein said release member includes a rod formed together with said locking element, said rod having an aperture into which at least one of said pegs extends and wherein said engagement means includes a locking notch in each of said circular portions for receiving a projecting part of the locking element.

11. A hanger as in claim 4 wherein said release member includes a rod formed together with said locking element, said rod having an aperture through which said peg extends and wherein said engagement means includes a locking notch in each of said circular portions for receiving a projecting part of the locking element.

12. A hanger as in claim 6 wherein the spring means comprises two resilient arms extending in opposite directions on separate sides of the rod, one resilient arm being located against the rod and one of the said circular portions and the other resilient arm being located against the rod and the other of the said circular portions.

13. A hanger as in claim 12 wherein the rod projecting part and resilient arms are formed as one piece, each resilient arm being located against a stop on the respective circular portion.

14. A hanger as in claim 1 wherein the spring means comprises a single strip of resilient material located in the enclosure and extending arcuately.

15. A hanger as in claim 3 wherein the spring means comprises a single strip of resilient material located in the enclosure and extending arcuately and wherein the strip is formed in one piece with means providing a carrying hook or by which a carrying hook may be attached and which provides an aperture into which the pegs extend.

16. A hanger as in claim 4 wherein the spring means comprises a single strip of resilient material located in the enclosure and extending arcuately and wherein the strip is formed in one piece with means providing a carrying hook or by which a carrying hook may be attached and which provides an aperture into which the peg extends.

17. A hanger as in claim 6 wherein the spring means comprises a single strip of resilient material located in the enclosure and extending arcuately, said strip being formed in one piece with said rod and said projecting part.

18. A hanger as in claim 1 wherein said arms comprise metal wires connected to said circular portions.

19. A folding clothes hanger comprising two arms each having an inner end and an outer end, each of said inner ends terminating in a circular portion, said circular portions being arranged in overlapping relationship and defining between them an internal space, means mounting said circular portions for rotation about a common axis so that said arms may swing between a folded position and a clothes-hanging position, a locking element in said internal space movable between a locking position in which it locks said arms in their clothes-hanging position and an unlocking position in which said arms can swing to their folded position, spring means in said internal space urging said locking element toward its locking position, and a manually operable release member extending out from said space for moving said locking element to its unlocking position.

* * * * *